United States Patent [19]

Braun

[11] 4,350,089

[45] Sep. 21, 1982

[54] FRUIT JUICE PRESS

[75] Inventor: Oskar Braun, Lindenfels, Fed. Rep. of Germany

[73] Assignee: Josef Willmes GmbH, Bensheim, Fed. Rep. of Germany

[21] Appl. No.: 202,644

[22] Filed: Oct. 31, 1980

[30] Foreign Application Priority Data

Nov. 9, 1979 [DE] Fed. Rep. of Germany ..... 2945254

[51] Int. Cl.[3] ..... B30B 5/02; B30B 9/22

[52] U.S. Cl. ..... 100/116; 100/211

[58] Field of Search ..... 100/116, 121, 122, 110, 100/112, 104, 211; 210/350, 351

[56] References Cited

U.S. PATENT DOCUMENTS

| | | | |
|---|---|---|---|
| 2,420,680 | 5/1947 | Pipkin | 100/211 X |
| 4,024,810 | 5/1977 | Braun | 100/211 X |
| 4,106,404 | 8/1978 | Schmid | 100/211 X |
| 4,140,051 | 2/1979 | Hauser et al. | 100/211 X |
| 4,151,795 | 5/1979 | Hauser | 100/211 X |

FOREIGN PATENT DOCUMENTS

| | | | |
|---|---|---|---|
| 401495 | 7/1909 | France | 100/211 |
| 1049205 | 8/1953 | France | 100/211 |
| 313442 | 5/1956 | Switzerland | 100/211 |

*Primary Examiner*—Peter Feldman

*Attorney, Agent, or Firm*—Kinzer, Plyer, Dorn & McEachran

[57] ABSTRACT

A press for squeezing juice-containing materials, like grapes, fruit-mashes and the like, by a closed container rotatable around its longitudinal horizontal axis, whereby a filling opening, covered by a perforated sheet, is provided in the jacket of the container and a pressure membrane made of flexible or elastic material matching the shape of the container is provided inside the container at the edge of the filling opening and is fastened parallel to the plane passing through the axis of rotation, said membrane dividing the interior of the container into a pressure medium and a pressure space. A loosening and draining device is provided in the pressure space inside the container opposite the filling opening and opposing the pressure membrane.

9 Claims, 4 Drawing Figures

FRUIT JUICE PRESS

This invention relates to a press for squeezing juice-containing materials, like grapes, fruit-mashes and the like, by a closed container rotatable around its longitudinal horizontal axis, whereby a filling opening is provided in the jacket of the container and a pressure membrane made of flexible or elastic material matching the shape of the container is provided inside the container and fastened parallel to the plane passing through the axis of rotation, said membrane dividing the interior of the container into a pressure medium and a pressure space.

A press of this type is already known (DE-OS No. 24 56 247). In one of its embodiments the flexible membrane in its nonloaded state occupies about half of the container, or in another embodiment featuring rubber-like elastic membrane having a plane surface, the arrangement and fastening is such that along the dividing plane passing through the axis of rotation along the container a series of mounting orifices are situated through which mounting flanges are screwed, whereby the edge of the membrane is clamped between them. Furthermore, drain passages and at least one perforated bottom sheet are located inside the pressure space. It is necessary to provide a man-hole on the cylinder side opposite the lid to make it possible to place the membrane into position and to carry out membrane replacements. Said known press has the disadvantage that a number of juice passages are in the pressure space, whose manufacture and mounting is costly. In the loosening phase the container must make a certain number of revolutions to sufficiently loosen the mash formed on the inside, and such operation, especially in the case of large presses, means substantial energy consumption since presses of this kind are of the order of up to 50 tons filling capacity. An additional disadvantage is that special husk-discharging devices are required.

The object of this invention is to propose a press which substantially shortens the squeezing time and at the same time improves the loosening effect. This object is achieved by:

(a) creating a filling opening covered by a perforated sheet, said opening being the juice passage,
(b) providing a loosening and draining device in the pressure space inside the container opposite the filling opening,
(c) fixing the membrane in a pressure medium tight manner at the edge of the filling opening as well as providing a loosening and draining device.

The invention features the significant advantage that a quicker and improved loosening effect can be achieved, thus shortening the squeezing time, meaning that the energy consumption of the squeezing process is reduced. A special husk-discharging means is not needed, because the squeezed mash can be removed through the filling opening. Moreover, juice drain channels are not needed either. In the processing of certain mash types an air cushion may develop between the membrane and the mash in the pressure space, which impairs the squeezing process. This phenomenon does not develop in the press according to this invention.

Furthermore another advantage emerges in that the mounting of the pressure membrane and replacing a damaged pressure membrane can be carried out by unskilled workers very quickly through the normal lid opening. The shape of the lid opening may be oval, circular, or rectangular; the opening may be in the middle of the cylinder or it can go through from one end of the container to the other. The fact that the material to be squeezed by the membrane does not come into contact with the internal wall of the pressure cylinder, but instead the material is in the region of the lid and the loosening and draining device, no extra treatment, like lacquering or plastic coating or costly high-grade steel constructions is needed.

The invention will be better understood by the following description illustrated by drawings representing embodiment examples.

Figure 2:
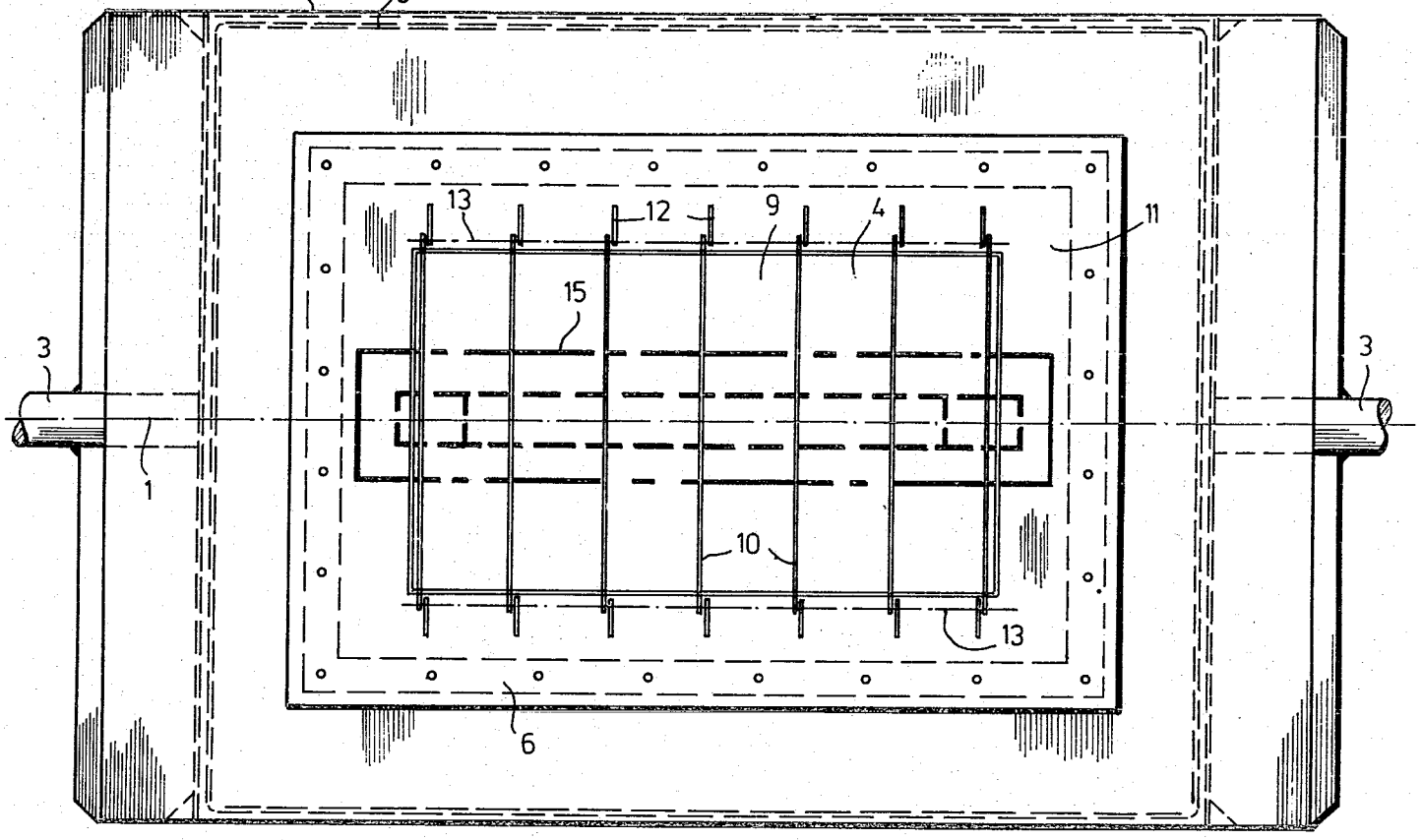
FIG. 2 is a top view of the press with the filling opening.

The press shown in the drawing features a cylindrical elongated container 2 extending in the direction of the horizontal axis 1 of the container 2, whereby on both sides stub shafts 3 are provided on which the container 2 is pivotably supported. The container 2 has a filling opening 4, FIGS. 2 and 3, which is rectangular in the represented embodiment example and is also preferred because it is simple to produce, however, the opening may be oval, or circular too. Moreover, it is also feasible that the opening 4 extends over the entire length of the container 2 to achieve good draining of the juice and to eliminate special husk-discharging components.

Figure 3:
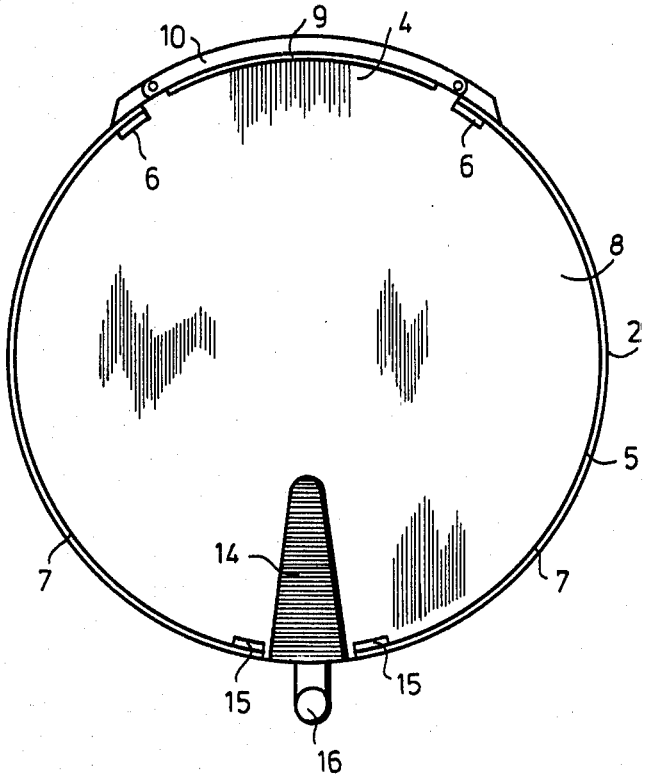
FIG. 3 is a sectional view along the line A—A of FIG. 1.
Figure 4:
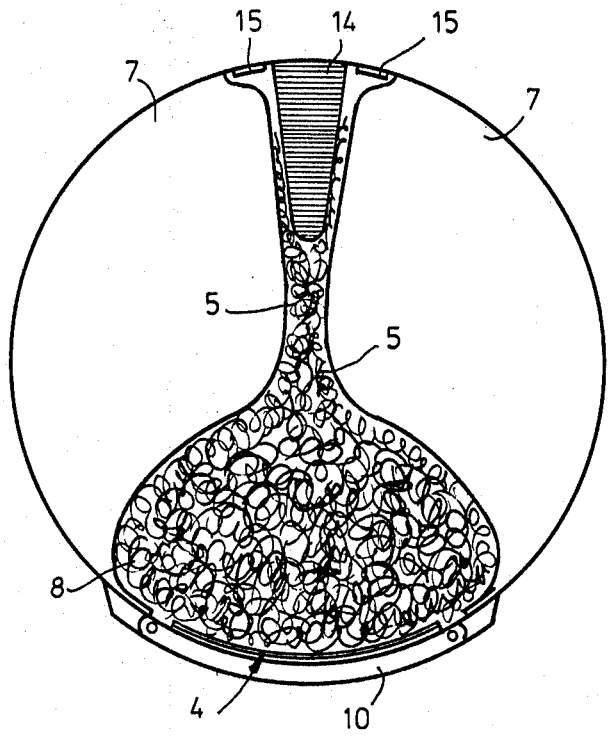
FIG. 4 is a representation according to FIG. 3 in pressing position.

Opposite the filling opening 4 inside the container 2 a loosening and discharging device 14 is provided which is directed towards the axis of rotation 1 and has a triangular or multiangular cross-section (FIGS. 3 and 4). In the embodiment example shown in the drawing a triangle has been chosen, whose tip directed towards the axis of rotation is rounded. This tip can also be flat, and thus the cross-section becomes trapezoid. The length of this device 14 featuring a kind of a channel, corresponds to the length of the filling opening 4, whereby its height may be of about one fourth to one half of the diameter of the container.

A membrane 5 is provided inside the container 2 being made of flexible material, for example plastics reinforced by woven fabric, or elastic rubber, therefore extendable and capable of being deflected in the course of the pressing out procedure into any one of the container halves.

The membrane 5 inside the container 2 in the region of the filling opening 4 and also in the region of the loosening and discharging device 14, is held with flanges 6,15 in such a way that a pressure medium space 7 and a squeezing space 8 are formed, whereby the loosening and discharging device 14, as well as the filling opening 4 are in the squeezing space 8.

It may be advantageous from a production point of view to prepare the membrane 5 of parts, whereby the division plane passes, for example, through the plane determined by the axis of rotation 1, the middle of the opening 4 and the loosening and discharging device 14.

The opening 4 of the container is covered by a perforated sheet 9, whereby the shape of the perforated sheet and that of the flange 6 correspond to the shape of the container. A corresponding perforated sheet may be provided on the loosening and discharging device 14 too, whereby in the case of extremely highly fluid material a filtering cloth may be employed.

An additional construction extending into the squeezing space may be provided on the inner side of the perforated sheet 9 of the lid. Said construction having the task of increasing the loosening effect, should not be as high as the device 14, whereby its length extends over the entire opening 4. Said construction lets the juice through and consists preferably of perforated sheet covering the entire opening 4 and fastened to the perforated sheet 9. This carries the advantage that a filtering cloth may be provided on this construction beforehand, thus the complete unit may be attached to the lid.

The perforated sheet 9 has a number of traverses 10, therefore an additional flange 11 may be applied on the outside of the opening of the container, said flange having eyes 12, whereby the connection between eyes and traverses 10 can be easily done by pushing bolts 13 through on both sides. Should, for example, such a bolt removed on one side, then the perforated sheet 9 can be turned up on one side.

Figure 1:
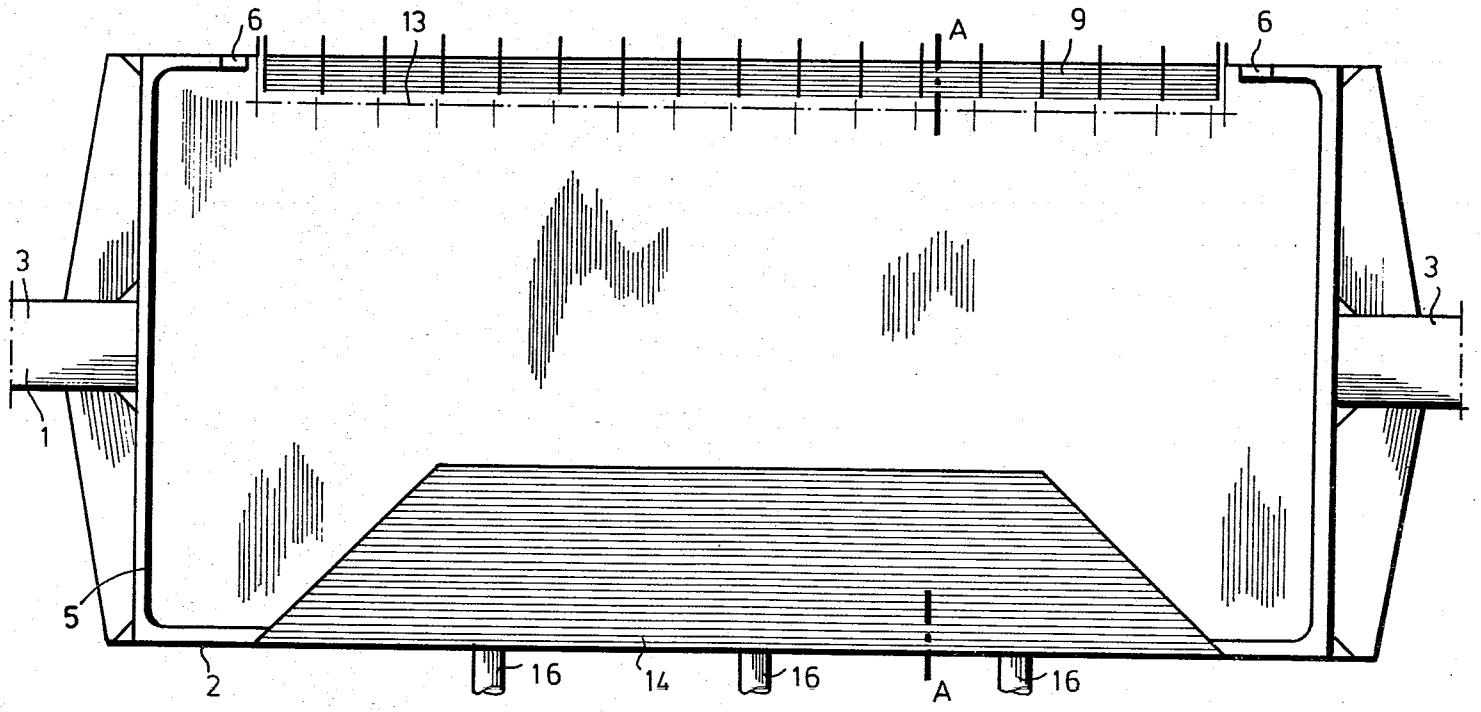
FIG. 1 is a longitudinal section of the type of press defined in the invention.

The mash is fed in through the opening 4, when the container 2 is in the position shown in FIGS. 1 and 3. The juice separated during the filling phase can flow over the loosening and draining device 14 featuring individual pipe connections 16, whereby a juice-collecting trough is provided underneath the press. An extensive preliminary juice extraction can be done in simple manner by rotating the container 2 a few times before applying any squeezing pressure. The squeezing process proper is carried out in one position, which in contrast with the position shown in FIG. 1 is turned by 180° downwards, thus the opening 4 is also below (FIG. 4).

I claim:

1. A press for squeezing juice-containing materials, like grapes, fruit-mashes and the like, by a closed container rotatable around a horizontal, longitudinal axis, a filling opening being provided in the jacket of the container, a pressure membrane made of flexible or elastic material being provided inside the container and fastened parallel to a vertical plane passing through the axis of rotation, said membrane dividing the interior of the container into an outer pressure-medium space and an inner squeeze space, characterized in that:

(a) there is a filling opening (4) in the container covered by a perforated sheet (9) to serve as a juice-draining means, (b) that an elongated loosening and draining device (14) is positioned in the squeeze space (8) opposite the filling space and opposing the pressure membrane, and (c) that the pressure membrane (5) is tightly fastened to the opposite edges of the filling opening (4) and on opposite sides of the loosening and draining device (14).

2. A press in accordance with claim 1, characterized in that the membrane is symmetrically divided by said vertical plane passing through the axis of rotation (1), the middle of the opening (4), and the middle of the loosening and draining device (14).

3. A press in accordance with claim 1 or 2, characterized in that the filling opening (4) extends in the direction of the axis (1) of rotation of the container almost over the entire length of the container (2) and the loosening and draining device (14) has a corresponding length.

4. A press in accordance with claim 3, characterized in that the opening (4) is rectangular and the perforated sheet (9) covering the opening (4) corresponds to the form of the container.

5. A press in accordance with claim 1 or 4, characterized in that the cross-section of the loosening and draining device (14) is triangular or multi-angular.

6. A press in accordance with claim 5, characterized in that the loosening and draining device (14) has a perforated jacket or a filtering cloth.

7. A press in accordance with claim 1 or 2 characterized in that the membrane (5) is fastened at the inside of the container (2) by screwed-in flange-components (6,15).

8. A press in accordance with claim 1 or 2 characterized in that the opening (4) with the perforated sheet (9) is closed by an airtight lid which opens outward towards the outside, and further characterized in that there is a pipe connection beneath the device (14) for juice collection.

9. A press in accordance with claim 8, characterized in that a cloth or a filtering layer is clamped between the perforated sheet (9) and the edge of the opening (4).

* * * * *